US010080393B2

(12) United States Patent
Ortiz

(10) Patent No.: US 10,080,393 B2
(45) Date of Patent: Sep. 25, 2018

(54) CONVERTIBLE GARMENT

(71) Applicant: Jennifer Ortiz, Miami Beach, FL (US)

(72) Inventor: Jennifer Ortiz, Miami Beach, FL (US)

( * ) Notice: Subject to any disclaimer, the term of this patent is extended or adjusted under 35 U.S.C. 154(b) by 195 days.

(21) Appl. No.: 13/939,867

(22) Filed: Jul. 11, 2013

(65) Prior Publication Data

US 2013/0326795 A1 Dec. 12, 2013

Related U.S. Application Data

(63) Continuation-in-part of application No. 13/491,585, filed on Jun. 7, 2012, now abandoned.

(51) Int. Cl.

| | |
|---|---|
| ***A41D 15/00*** | (2006.01) |
| ***A47G 9/06*** | (2006.01) |
| ***A42B 1/04*** | (2006.01) |
| ***A41D 15/04*** | (2006.01) |
| *A41D 23/00* | (2006.01) |
| *A41D 1/215* | (2018.01) |

(52) U.S. Cl.

CPC ..... *A41D 15/00* (2013.01); *A41D 15/04* (2013.01); *A42B 1/041* (2013.01); *A47G 9/064* (2013.01); *A47G 9/066* (2013.01); *A41D 1/215* (2018.01); *A41D 23/00* (2013.01)

(58) Field of Classification Search

CPC ..... A47G 9/06; A47G 9/062; A47G 9/064; A47G 9/066; A47K 10/02; A42B 1/041; A41D 15/00; A41D 15/04; A41D 23/00; A45F 4/00

USPC ..... 2/89, 243.1; 5/494

See application file for complete search history.

(56) References Cited

U.S. PATENT DOCUMENTS

| | | | | | |
|---|---|---|---|---|---|
| 578,691 | A * | 3/1897 | Conant | A41D 15/04 | 135/119 |
| 1,157,341 | A * | 10/1915 | Tallerday | A41D 23/00 | 2/59 |
| 1,285,917 | A * | 11/1918 | Bradley et al. | A41D 1/04 | 2/158 |
| 1,922,169 | A * | 8/1933 | Martin | A47K 10/02 | 15/222 |
| 2,420,344 | A * | 5/1947 | Alexander | A47G 9/064 | 2/69 |
| 3,416,518 | A * | 12/1968 | Samuels | A61F 15/004 | 2/16 |
| 4,654,906 | A * | 4/1987 | Roberts | A47G 9/06 | 428/102 |

(Continued)

*Primary Examiner* — Jameson Collier

(74) *Attorney, Agent, or Firm* — Johnson & Martin, P.A.; James David Johnson

(57) ABSTRACT

A convertible garment may be constructed from a material having a bulk section between opposing ends. The material may substantially encircle bands located at the opposing ends. Bundling strings may encircle the material near the ends with an adjustable and independent level of compactness. Additionally, connecting strings may be attached to the material at the ends for positioning the opposing ends of the material adjacent to one another. Compactness of the majority of the material in the bulk section may be adjustable relative to a desired coverage of a wearer. The material may be hemmed. Stitching may be included near the ends to supplement the bundling strips. The material may be a textile that is adjustable to cover a length of the wearer up to between shoulders and hips of the wearer. A method of using the convertible garment is also disclosed.

2 Claims, 10 Drawing Sheets

(56) References Cited

U.S. PATENT DOCUMENTS 4,706,304 A * 11/1987 Jones ..... A41D 1/04 2/91
5,062,256 A * 11/1991 Kingett ..... A01K 13/006 54/78
5,110,219 A * 5/1992 Lopes ..... A45C 3/10 190/2
D364,705 S * 11/1995 Frame ..... D28/41
5,472,003 A * 12/1995 Frame ..... A45D 8/34 132/273
5,628,062 A * 5/1997 Tseng ..... A41D 13/08 2/16
5,644,807 A * 7/1997 Battistella ..... A45C 3/10 5/417
5,727,575 A * 3/1998 Rontal ..... A45D 8/34 132/200
D442,765 S * 5/2001 Newman ..... D2/610
6,665,876 B1 * 12/2003 Newman ..... A41D 13/08 2/207
D578,278 S * 10/2008 Song ..... D2/823
8,016,484 B1 * 9/2011 Cross ..... A45C 3/00 383/16
2003/0150044 A1 * 8/2003 Hoy ..... A41D 13/08 2/125
2007/0028345 A1 * 2/2007 McCarty ..... A41D 13/08 2/59
2007/0044236 A1 * 3/2007 Tatsuno ..... A47G 9/086 5/420
2008/0235870 A1 * 10/2008 Heide ..... A47G 9/04 5/484
2009/0199337 A1 * 8/2009 Long ..... A47G 9/068 5/494
2010/0089958 A1 * 4/2010 Flagel ..... A45C 3/10 224/576
2010/0275946 A1 * 11/2010 Ruschell ..... A41D 20/00 132/210
2011/0047697 A1 * 3/2011 McBrearty ..... A47G 9/062 5/417
2012/0066816 A1 * 3/2012 Starr ..... A41D 27/12 2/243.1
2013/0326795 A1 * 12/2013 Ortiz ..... A41D 15/00 2/243.1

* cited by examiner

CONVERTIBLE GARMENT

CROSS-REFERENCE TO RELATED APPLICATION

This application is a continuation-in-part and claims the priority from U.S. patent application Ser. No. 13/491,585 filed Jun. 7, 2012. The foregoing application is incorporated in its entirety herein by reference.

FIELD OF THE INVENTION

The invention relates to clothing. More particularly, the invention relates to articles of clothing that are convertible for wearing in different functional manners and styles.

BACKGROUND

Clothing garments have been an essential part of human life and culture for the vast majority of human existence. As people have progressed through history, so too have the clothing garments they wear. However, despite the advancements made in clothing, people continue to keep large collections of to fulfill a plethora of functional needs or fashion desires. Building such a collection could require large financial investments. Likewise, storing and transporting such collections of clothing may require a large amount of space and effort. A solution is needed that is presently absent from the prior art.

Much advancement has been made to increase the functional versatility of the cloths in a person's wardrobe. Buttons, zippers, and snaps allow garments to be selectable between encircling a wearer or remaining open. Belts, elastic, and draw strings provide garments with some adjustability, allowing the clothing to be worn by a more varying number of people. Even combinations of these and other modifications have been collectively integrated into articles of clothing. However, as more modifications are made, the complexity and effort associated with each article of clothing may increase. What is needed is a garment that provides substantial flexibility without unnecessary added complexity.

In addition to function, fashion is often a large deciding factor in selecting which garments to include in a personal wardrobe. Fashion changes often, and future trends can be unpredictable. Continually refreshing a wardrobe to include garments that are both functional and fashionable can require a large investment of time and money. What is needed is a functional, adaptable garment that is resistant to the frequent changes of fashion.

SUMMARY

According to embodiments of the present invention, a convertible clothing garment is described that may be warn in a large variety of ways. In one aspect, the garment of the present invention may be selectively worn to provide substantial flexibility without adding unnecessary complexity. In another aspect, the garment of the present invention may be worn in a plurality of ways, adaptably providing functional use while remaining fashionably relevant.

The convertible garment can include a material, bundling strings, and connecting strings. The material may be a substantially continuous, single, unitary piece of material having a bulk section between opposing ends that include a first end and a second end. The material may be manipulable to cover at least part of a wearer.

The bundling strings may be positionable to at least partially encircle the material near the ends. The bundling strings may also be adjustably tied to bundle the material with an adjustable level of compactness. The bundling string may be independently adjustable at each of the ends.

The connecting strings may be located at the ends. The connecting strings may include a first connecting string at the first end of the material and a second connecting string at the second end of the material. The first connection string and the second connection string may be connectable to position the first end of the material adjacent to the second end of the material. The connection strings may be attached at the ends of the material.

A majority of the material may be included in the bulk section of the garment. The compactness of the majority of material may be adjustable. The part of the wearer covered by the material may also be adjustable by the wearer. The bulk section of the material may be adjustable to cover the wearer up to a length between shoulders and hips of the wearer.

Accordingly, the invention features a convertible garment that includes a material having a bulk section between opposing ends that include a first end and a second end, the material being manipulable to cover at least part of a wearer. The convertible garment also includes bundling strings positionable to at least partially encircle the material near the first and second ends, the bundling strings being adjustably connectable to bundle the material with an adjustable level of compactness, and each bundling string being independently adjustable at its respective first end or second end. The convertible garment further includes connecting strings attached to the material located at the first and second ends, wherein the connecting strings include a first connecting string attached to the first end and a second connecting string attached to the second end, the first connecting string and the second connecting string being connectable to position the first end of the material adjacent to the second end of the material. A majority of the material is included in the bulk section with the compactness of the majority of the material being adjustable. The part of the wearer covered by the material is adjustable by the wearer.

In another aspect, the invention can feature at least part of the material being hemmed.

In another aspect, the invention can feature stitching near the first and second ends to at least partially secure the compactness of the material near the first and second ends.

In another aspect, the invention can feature the bulk section and the first and second ends being formed from a single unitary piece of material.

In another aspect, the invention can feature the material being a textile.

In another aspect, the invention can feature the bulk section being adjustable to cover a length of the wearer's body up to between shoulders and hips of the wearer.

The invention also features a garment for use by humans that includes a single unitary piece of material having a bulk section between opposing ends that include a first end and a second end, the material being manipulable to cover at least part of a wearer. The garment also features first and second bundling strings positionable to at least partially encircle the material near the first and second ends, the bundling strings being capable of being adjustably tied to bundle the material with an adjustable level of compactness, and each bundling string being independently adjustable at each of the respective first and second ends. The garment further includes connecting strings located at each of the first and second ends including a first connecting string at the first end and a second connecting string at the second end, the first connecting string and the second connecting string being connectable to position the first end of the material adjacent to the second end of the material. A majority of the material is included in the bulk section with the compactness of the majority of material being adjustable. The part of the wearer covered by the material is adjustable by the wearer. The bulk section is adjustable to cover the wearer's body up to a length between shoulders and hips of the wearer.

In another aspect, the invention can feature at least part of the material being hemmed.

In another aspect, the invention can feature stitching near at least one of the first and second ends to at least partially secure the compactness of the material near the ends.

In another aspect, the invention can feature the material being a textile.

In another aspect, the invention can feature the connection strings being attached to the material.

A method is provided for using a convertible garment, wherein the garment features a material having a bulk section and opposing ends, bundling strings to at least partially encircle the material near the ends, and connecting strings located at the ends that are connectable to position the ends adjacent to one another. The method includes the steps of: (a) adjusting the bundling strings to achieve a desired compactness of the material near the first and second ends; (b) preparing the garment to be positioned adjacent to at least part of the wearer, the connecting strings being connectable such to at least partially encircle the garment around at least part of the wearer; (c) positioning the garment to cover at least part of the wearer; and (d) manipulating the compactness of the bulk section relative to the length of the wearer to be covered. The ends feature a first end and a second end, the connecting strings attached to the material located at the ends including a first connecting string at the first end of the material and a second connecting string located at the second end of the material, and the first and second connecting strings being connectable to position the first end of the material adjacent to the second end of the material. A majority of the material is included in the bulk section. The part of the wearer covered by the material is adjustable by the wearer.

Another method of the invention can feature the additional step of: (e) wrapping the bulk section of the material around a body of the wearer.

In another aspect, the invention can feature the additional steps of: (f) using the bundling strings to at least partially encircle the material near the first and second ends; and (g) adjusting the bundling strings to bundle the material near the ends with a selectable level of compactness, wherein the bundling strings are independently adjustable at each of the first and second ends.

In another aspect, the invention can feature at least part of the material being hemmed.

In another aspect, the invention can feature the material being stitched adjacent to the bundling strings to provide a minimum compactness of the material near the ends.

In another aspect, the invention can feature the bulk section of the material and first and second ends being formed from a single unitary piece of material.

In another aspect, the invention can feature the material being a textile.

In another aspect, the invention can feature the bulk section being adjustable to cover a length of the wearer up to between shoulders and hips of the wearer.

According to an embodiment of the present invention, a convertible garment is presented with a material, a first band, and a second band. The material may include a bulk section between opposing ends that include a first end and a second end, the material being manipulable to cover at least part of a wearer. The first band may be attached near the first end to substantially encircle the material around the first band, the first band having a first opening. The second band may be attached near the second end to substantially encircle the material around the second band, the second band having a second opening. The first band and the second band may include stretchable material. A majority of the material may be included in the bulk section. A compactness of the majority of the material may be adjustable. A part of the wearer covered by the material may be adjustable by the wearer. The first end of the material is insertable in the second opening or the second end of the material is insertable in the first opening.

According to an embodiment of the present invention, a garment is provided for use by humans that includes a material, a first band, and a second band. The material may be a single unitary piece of material that includes a bulk section between opposing ends having a first end and a second end. The material may be manipulable to cover at least part of a wearer. The first band may be attached near the first end to substantially encircle the material around the first band, the first band having a first opening. The second band may be attached near the second end to substantially encircle the material around the second band, the second band having a second opening. A majority of the material may be included in the bulk section. A compactness of the majority of material is adjustable. The part of the wearer covered by the material is adjustable by the wearer. The bulk section is adjustable to cover a length of the wearer between up to shoulders and hips of the wearer.

Unless otherwise defined, all technical terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents and other references mentioned herein are incorporated by reference in their entirety. In the case of conflict, the present specification, including definitions will control.

DETAILED DESCRIPTION

Figure 1:
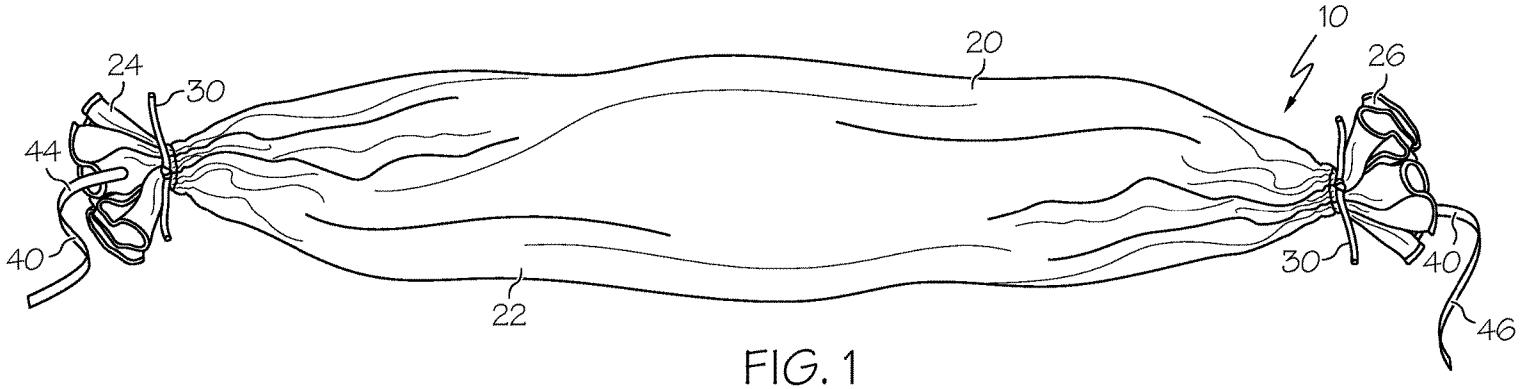
FIG. 1 is a side elevation view of a garment, according to an embodiment of the present invention.

The present invention is best understood by reference to the detailed drawings and description set forth herein.

Embodiments of the invention are discussed below with reference to the drawings; however, those skilled in the art will readily appreciate that the detailed description given herein with respect to these figures is for explanatory purposes as the invention extends beyond these limited embodiments. For example, in light of the teachings of the present invention, those skilled in the art will recognize a multiplicity of alternate and suitable approaches, depending upon the needs of the particular application, to implement the functionality of any given detail described herein beyond the particular implementation choices in the following embodiments described and shown. That is, numerous modifications and variations of the invention may exist that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The present invention should not be limited to the particular methodology, compounds, materials, manufacturing techniques, uses, and applications, described herein, as these may vary. The terminology used herein is used for the purpose of describing particular embodiments only, and is not intended to limit the scope of the present invention. As used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" may be a reference to one or more steps or means and may include sub-steps and subservient means.

All conjunctions used herein are to be understood in the most inclusive sense possible. Thus, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should be read as "and/or" unless expressly stated otherwise. Structures described herein are to be understood also to refer to functional equivalents of such structures. Language that may be construed to express approximation should be so understood unless the context clearly dictates otherwise.

Unless otherwise defined, all terms (including technical and scientific terms) are to be given their ordinary and customary meaning to a person of ordinary skill in the art, and are not to be limited to a special or customized meaning unless expressly so defined herein.

Terms and phrases used in this application, and variations thereof, especially in the appended claims, unless otherwise expressly stated, should be construed as open ended as opposed to limiting. As examples of the foregoing, the term "including" should be read to mean "including, without limitation," "including but not limited to," or the like; the term "having" should be interpreted as "having at least"; the term "includes" should be interpreted as "includes but is not limited to"; the term "example" is used to provide exemplary instances of the item in discussion, not an exhaustive or limiting list thereof; and use of terms like "preferably," "preferred," "desired," "desirable," or "exemplary" and words of similar meaning should not be understood as implying that certain features are critical, essential, or even important to the structure or function of the invention, but instead as merely intended to highlight alternative or additional features that may or may not be utilized in a particular embodiment of the invention.

Those skilled in the art will also understand that if a specific number of an introduced claim recitation is intended, such an intent will be explicitly recited in the claim, and in the absence of such recitation no such intent is present. For example, as an aid to understanding, the appended claims may contain usage of the introductory phrases "at least one" and "one or more" to introduce claim recitations; however, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C" is used, in general, such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C" is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.).

All numbers expressing dimensions, quantities of ingredients, reaction conditions, and so forth used in the specification are to be understood as being modified in all instances by the term "about" unless expressly stated otherwise. Accordingly, unless indicated to the contrary, the numerical parameters set forth herein are approximations that may vary depending upon the desired properties sought to be obtained.

The present invention will now be described in detail with reference to embodiments thereof as illustrated in the accompanying drawings. In the following description, a convertible garment will be discussed. Those of skill in the art will appreciate alternative labeling of the garment as clothing, clothes, articles of clothing, the invention, or other similar names. Skilled readers should not view the inclusion of any alternative labels as limiting in any way.

Referring now to FIG. 1, a convertible garment 10 will now be discussed generally. At its most basic level, the garment 10 may be constructed from a piece of material and connecting strings 40. The piece of material, which may be referred to herein as the material 20, may be made from virtually any fabric or composition that is at least partially flexible and may be manipulated by a wearer of the garment 10. The material 20 may be a textile, such as cotton, nylon, hemp, polyester, or any other natural or synthetic material 20 that may be woven or knitted into a cloth. Alternatively, the material 20 may be an animal based material 20, such as, for example, silk, fur, or leather. The material 20 may also have elastic or stretching properties. Those of skill in the art will appreciate that the preceding materials 20 are provided as examples and should not be view to limit the present invention in any way.

Figure 3:
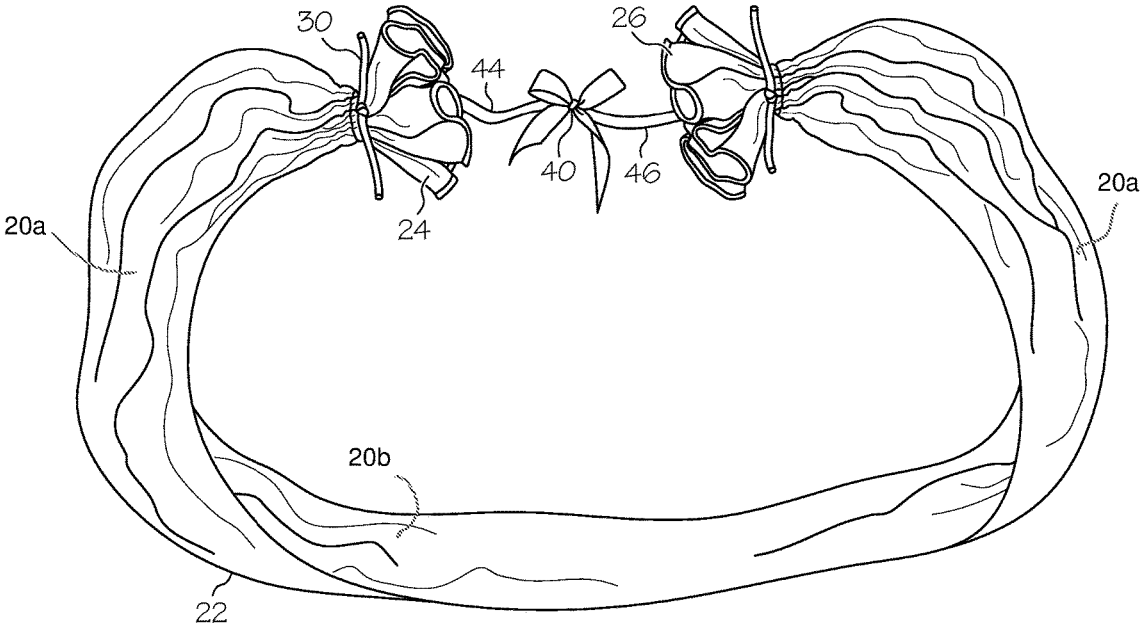
FIG. 3 is a partial side elevation view illustrating the ends of the garment of FIG. 1 being positioned adjacently by connecting the connection strings, according to an embodiment of the present invention.
Figure 6:
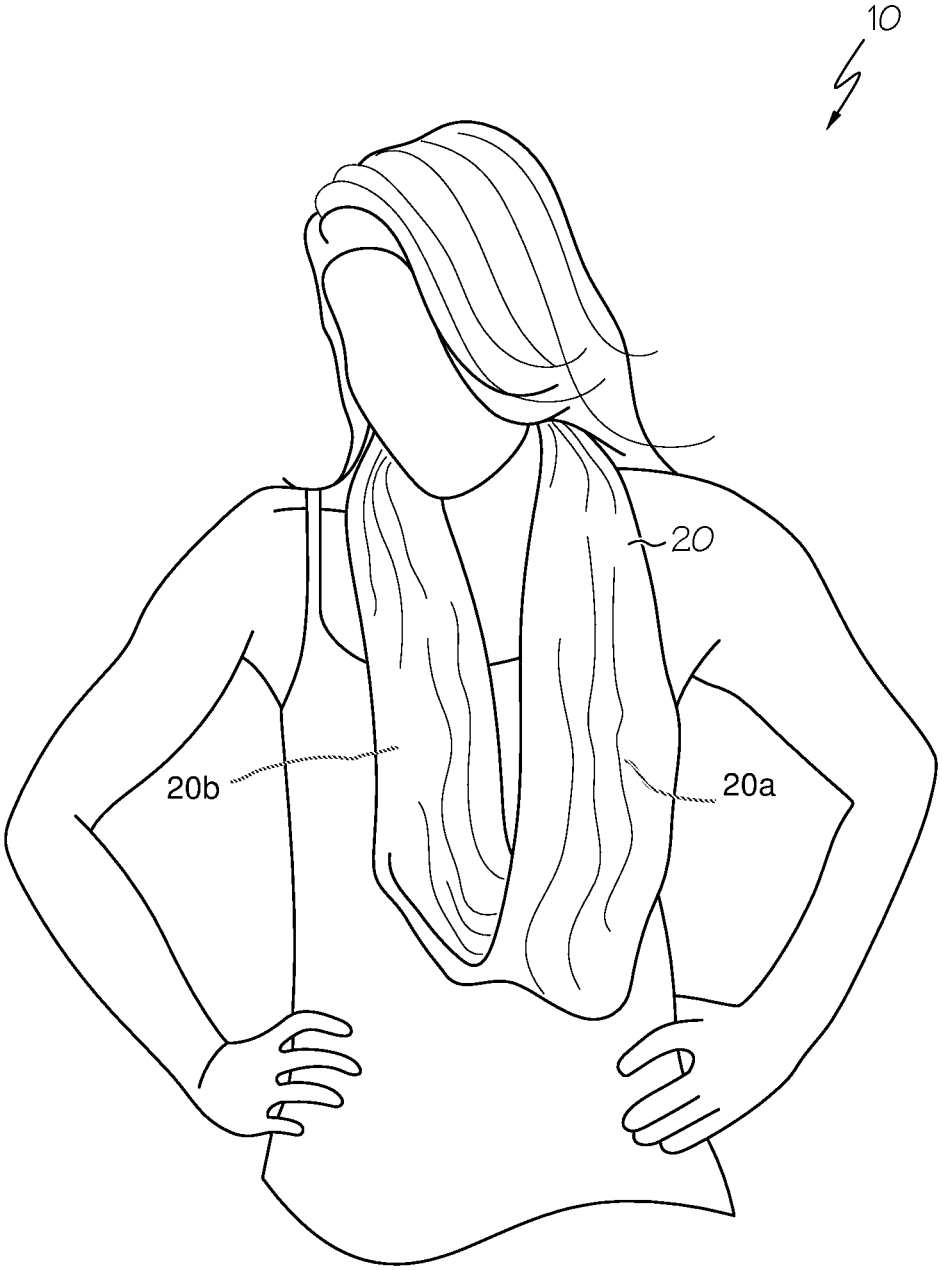

The material 20 may originally be woven or cut into any number of shapes or configurations. In one embodiment of the present invention, which is provided in the interest of clarity and without the intent of limitation, the material 20 may be woven into a rectangular shape. As shown in FIGS. 3 and 6, the rectangular material 20 is planar or flat in construction and includes a first surface 20*a* and a second surface 20*b* that is on an opposite side of the rectangular material in relation to the first surface. The length and width of the illustrative rectangular material 20 may vary from application to application, as different sizes of the material 20 may be desired for differing wearers and uses. In the example wherein the material 20 is rectangular, the material 20 may have two sets of substantially parallel sides (or edges), one set being vertical and the other set being horizontal. The horizontal sides may run the length of the garment 10, essentially providing the top and bottom boundaries of the garment 10. The vertical sides may provide opposing ends 24, 26 of the garment 10. As discussed below, the rectangular material 20 near the opposing ends 24, 26 may be collected or compacted to manipulate the shape of the garment 10. The horizontal sides are longer than the vertical sides and the horizontal sides are free-floating relative to one another.

Viewing the rectangular material 20 extended lengthwise and unfolded, such as illustrated in FIGS. 1 and 3, the rectangular material 20 may include a central bulk section 22 enclosed by two ends, a first end 24 and a second end 26. A continuous piece of rectangular material 20 may be used to form the garment 10. However, a person of skill in the art will appreciate that multiple pieces may be used to form the rectangular material 20 of the garment 10, which may be sewn or otherwise connected together. Multiple pieces of the rectangular material 20 may be formed of various compositions, for example, forming a rectangular material 20 quilted with cotton and silk pieces.

The compactness of the garment 10 at its several locations may vary. For example, the central bulk portion 22 may loosely include the material 20, while the first and second ends 24, 26 may compactly include the rectangular material 20 bundled by a string, such as a bundling string 30. The compactness of the rectangular material 20 may be manipulated by a wearer. Optionally, a minimum level of compactness may be established using pleating, stitching, or other manipulation techniques as the garment 10 is created, which will be discussed further below. As shown in FIGS. 1, 3, 11, and 12, the first end 24 can include a portion of the bulk section 22 at the first end compacted into a circular or annular configuration, and the second end 26 can include a portion of the bulk section 22 at the second end compacted into a circular or annular configuration.

Figure 2:
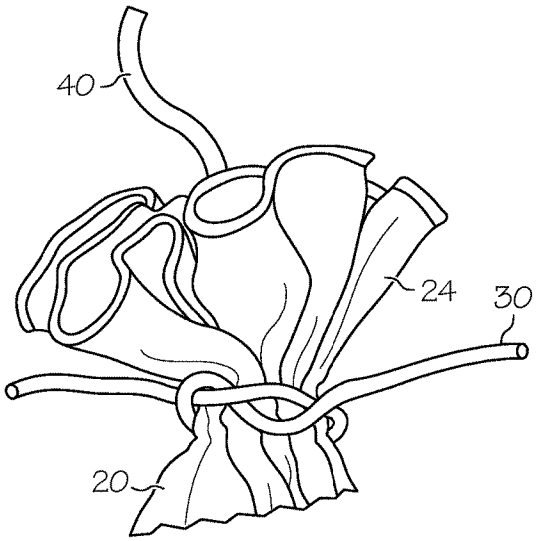
FIG. 2 is a partial side elevation view illustrating an end of the garment of FIG. 1, according to an embodiment of the present invention.

Referring additionally to FIG. 2, the bundling strings 30 may encircle the material 20 near the ends of the garment 10. In its simplest form, the bundling strings 30 may be used to tie a portion of the garment 10 so that the material 20 is compacted and collected approximately to about a single region. The bundling strings 30 may be a length of an animal based fiber, textile, or other string-like material 20. More specifically, provided as examples without limitation, a bundling strings 30 may be constructed from lace, leather, rope, twine, silk, or another string-like composition that would be apparent to skilled artisans.

Continuing with the example wherein the material 20 used to create the garment 10 is originated from a rectangular shape, the garment 10 may be configured with each vertical side being folded into waves and being collapsed, or "scrunched." The garment 10 may be held in this configuration by the bundling strings 30. A portion of the bundling strings 30 near its opposing ends 24, 26 of the garment 10 may be knotted, tied, or otherwise connected to at least partially secure the desired compactness of the material 20 near the ends 24, 26 of the garment 10. Optionally, the bundling strings 30 may be interwoven into the material 20 of the garment 10. Additional configurations of using the bundling strings 30 to bundle the material 20 near the ends 24, 26 will be apparent to skilled artisans after having the benefit of this disclosure, and are intended to be included in the scope of this disclosure.

In addition to bundling strings 30, connecting strings 40 may be included near the ends 24, 26 of the material 20. More specifically, a first connecting string 44 may be located at the first end 24 of the garment 10 and a second connecting string 46 may be located at the second end 26 of the garment 10. The connecting strings 40 may be fixedly attached to the material 20 of the garment 10, as to provide secure positioning of the ends of the garment 10 adjacent to one another upon the connecting strings 40 being tied or connected together. The fixed attachment may be accomplished by sewing, gluing, adhering, welding, or otherwise affixing the connecting strings 40 to the garment 10. In alternate embodiments, the connecting strings 40 may be adjustably attached to the material 20 of the garment 10. Removable connecting strings may be replaced to repair the garment 10 and/or coordinate styles with other articles of clothing being worn by the wearer. Examples of such removable attachment may include attaching the connecting strings 40 to the material 20 using buttons, snaps, zippers, hook-and-loops, and/or another adjustable attachment apparatus.

Similar to the bundling strings 30, the ends of the connecting strings 40 that may extend away from the garment 10 may be connected to additional strings, such as the connecting string 40 form the opposing side of the garment 10. This connection of the connecting strings 40 may be achieved by tying, snapping, buttoning, zipping, or otherwise connecting the strings to provide at least some resistance to becoming disconnected.

The connecting strings 40 may have a different composition than the bundling strings 30. The connection strings may also share similar composition as the bundling strings 30, so long as the composition is of sufficient strength to provide support for the garment 10 when a first connecting string 44, located at the first end 24 of the garment 10, is connected to a second connecting string 46 located at the second end 26 of the garment 10. Preferably, the connecting strings 40 may be stronger than the bundling strings 30. However, a person of skill in the art will appreciate that any strength of connecting string 40 may be used so long as the garment 10 can be supported during use. Additionally, if the connecting strings 40 are to be tied together, the connecting strings 40 may be long enough to be easily tied in a bow or similar knot without using the entire length of the string. The bundling strings 30 and connecting strings 40 may be the same single string, or may be two separate strings.

Figure 4:
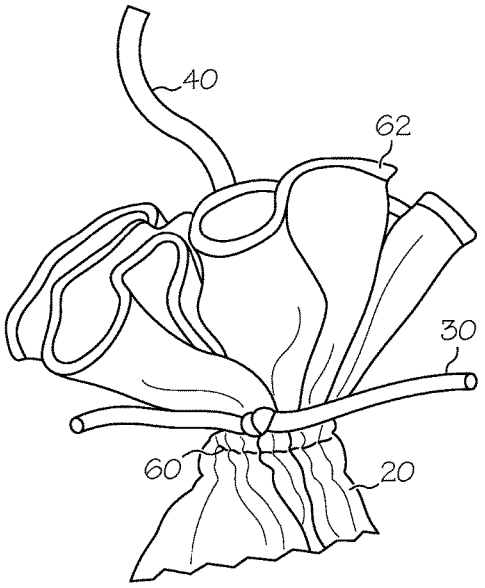
FIG. 4 is a partial side elevation view of a garment with optional stitching and hemming, according to various embodiments of the present invention.

In an embodiment of the present invention, as illustrated in FIG. 4, the material 20 may include hemming 62 at its edges to provide resistance to fraying and premature wear. The hemming may include a customized design. Alternatively, the hemming may be performed using a standard pattern.

In an embodiment of the present invention, as also illustrated in FIG. 4, the material 20 bundled near the ends 24, 26 of the garment 10 may include stitching 60 to increasing the security of the bundling. The stitching 60 may be included to supplement the effectiveness of the bundling strings 30. Alternatively, the stitching 60 may be included in substitution of the bundling strings 30. The material 20 may be stitched together near the end to provide a consistent minimum level of compactness. If a wearer desires the material 20 near the bundling string 30 to be more compact that the stitching may provide, the wearer may tighten the bundling strings 30 until the desired compactness is achieved. If the stitching is configured to provide adequate compacting of the material 20 near the ends, the bundling strings 30 may be included in the garment 10 for a decorative or ornamental effect.

For example, and without limitation, the material 20 near the ends 24, 26 of the garment 10 may be folded such that portions of the material 20 are located adjacent to additional portions of the material 20. The adjacently located portions of the material 20 may be at least partially stitched together. The bundling string 30 may then be used to bundle the stitched portions of the material 20 together, for instance, by bringing a top and bottom portion of the stitched material 20 together and being tied together by the bundling strings 30.

If the bundling strings 30 are interwoven with the material 20, the bundling strings 30 may pierce through various folds in the material 20. The ends of the bundling strings 30 may be tied together to make a loop. Alternatively, the ends of the bundling strings 30 may simply have knots that keep the material 20 from unfolding. Additionally, the connecting strings 40 may have one end fixedly or adjustably attached to a folded side of the material 20.

The garment 10, when constructed, may form an article of clothing that, when held upright, broadens in the central bulk section 22 and converges near the bundled ends 24, 26. The distal ends of the connecting strings 40 can then be tied together to form a garment 10 that may be used dynamically in a large number of configurations. Also, the garment 10 may be converted between various configurations substantially effortlessly. Examples of the various configurations for the garment 10 are provided below. However, the following examples are not intended to be exhaustive, as those of skill in the art will appreciate additional configurations by which the garment 10 of the present invention may be used. Reference to the following figures should be made in addition to the preceding figures, since some of the elements may not be pictured and/or labeled in each of figures that follow.

Figure 5:
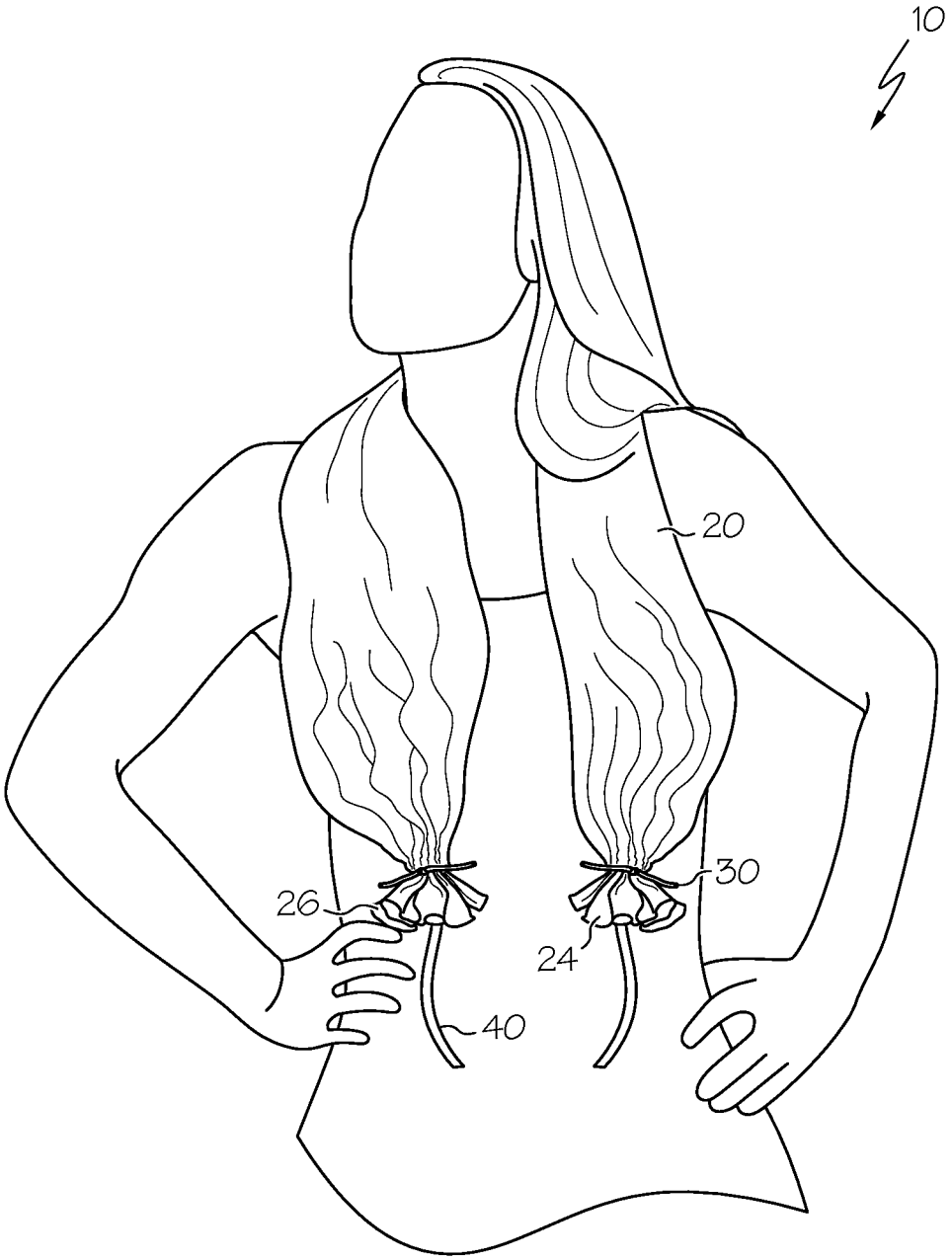
FIGS. 5-10 are illustrative uses of a garment, according to various embodiments of the present invention.

As illustrated in FIG. 5, the garment 10 may be used as a scarf. In this example, the bundling strings 30 may compact the material 20 near the ends 24, 26. Also, the material 20 may be kept compactly together such that it may be draped around the neck and shoulders of a wearer. Alternatively, the bundling strings 30 may be loosened, allowing the material 20 to be loosely bunched approximately uniformly along the length of the garment 10. In another example, as perhaps best illustrated in FIG. 6, the ends of the garment 10 may be located adjacent to one another by tying, or otherwise connecting, the connecting strings 40, for example, behind the back of the wearer. The tied scarf may then be positioned over the head, such that it may be draped over the shoulders of the wearer.

Figure 7:
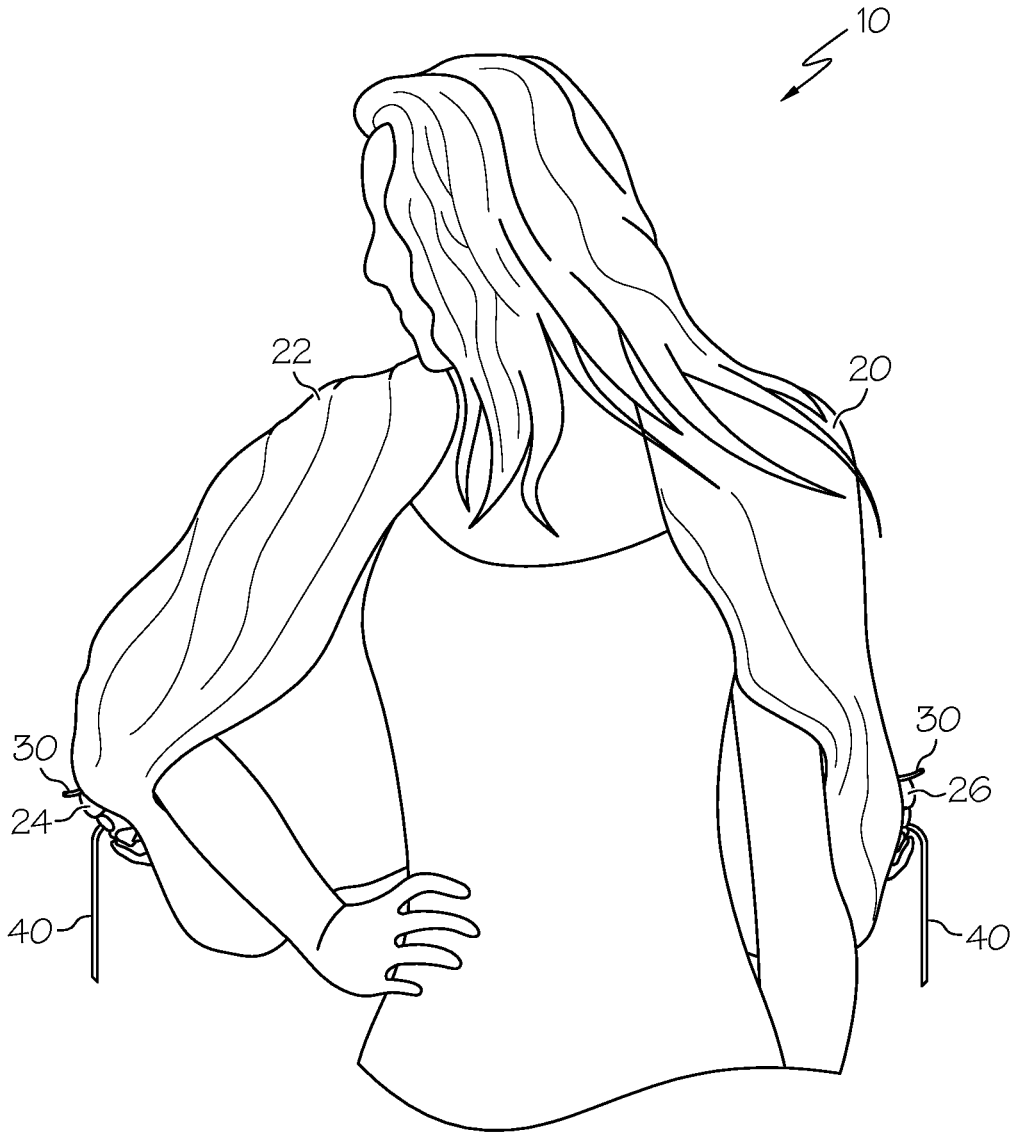

As illustrated in FIG. 7, the garment 10 may be used as a jacket. In this example, the bundling strings 30 may be loosened, untied, or removed from the material 20 near the ends 24, 26, allowing the material 20 to drape freely over the shoulders and upper body of the wearer. The connecting strings 40 may remain untied, allowing the material 20 to drape freely over the wearer's shoulders and torso as a jacket. Additionally, a selectable amount of material 20 may be loosened from the central bulk portion 22 of the garment 10 to cover a desired portion of the wearer's back and/or torso.

Figure 8:
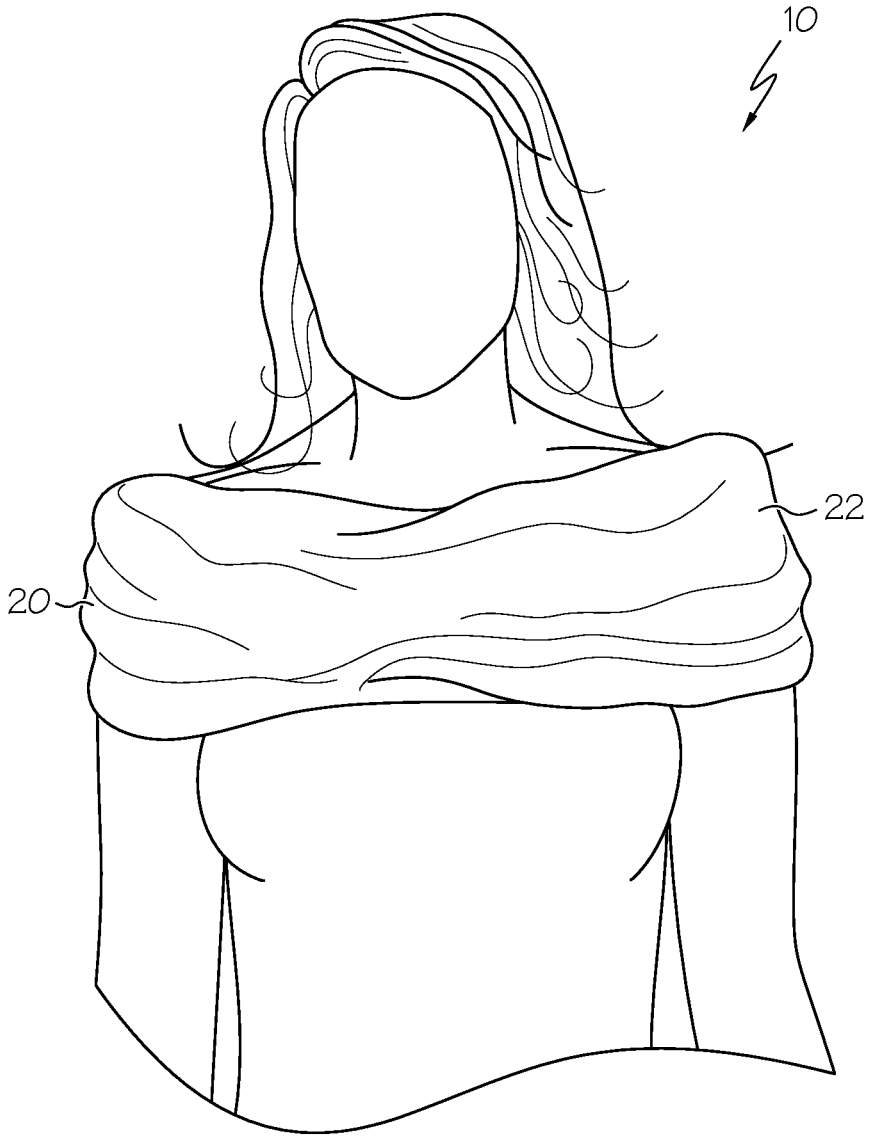

As illustrated in FIG. 8, the garment 10 may be used as a sweater. In this example, the bundling strings 30 may be tied around the material 20 near the ends 24, 26 to compact the material 20 to a desired width that may cover the shoulders and upper body of the wearer. The connecting strings 40 may be tied, such as at the back of a wearer, to allow the material 20 to be securely over at least the shoulders of the wearer. A selectable amount of material 20 may be loosened from the central bulk portion 22 of the garment 10 to cover a desired portion of the wearer's back and/or torso. This material 20 may be adjusted as the garment 10 is worn, advantageously providing an adjustable amount of warmth as the temperature of an environment may fluctuate.

Figure 9:
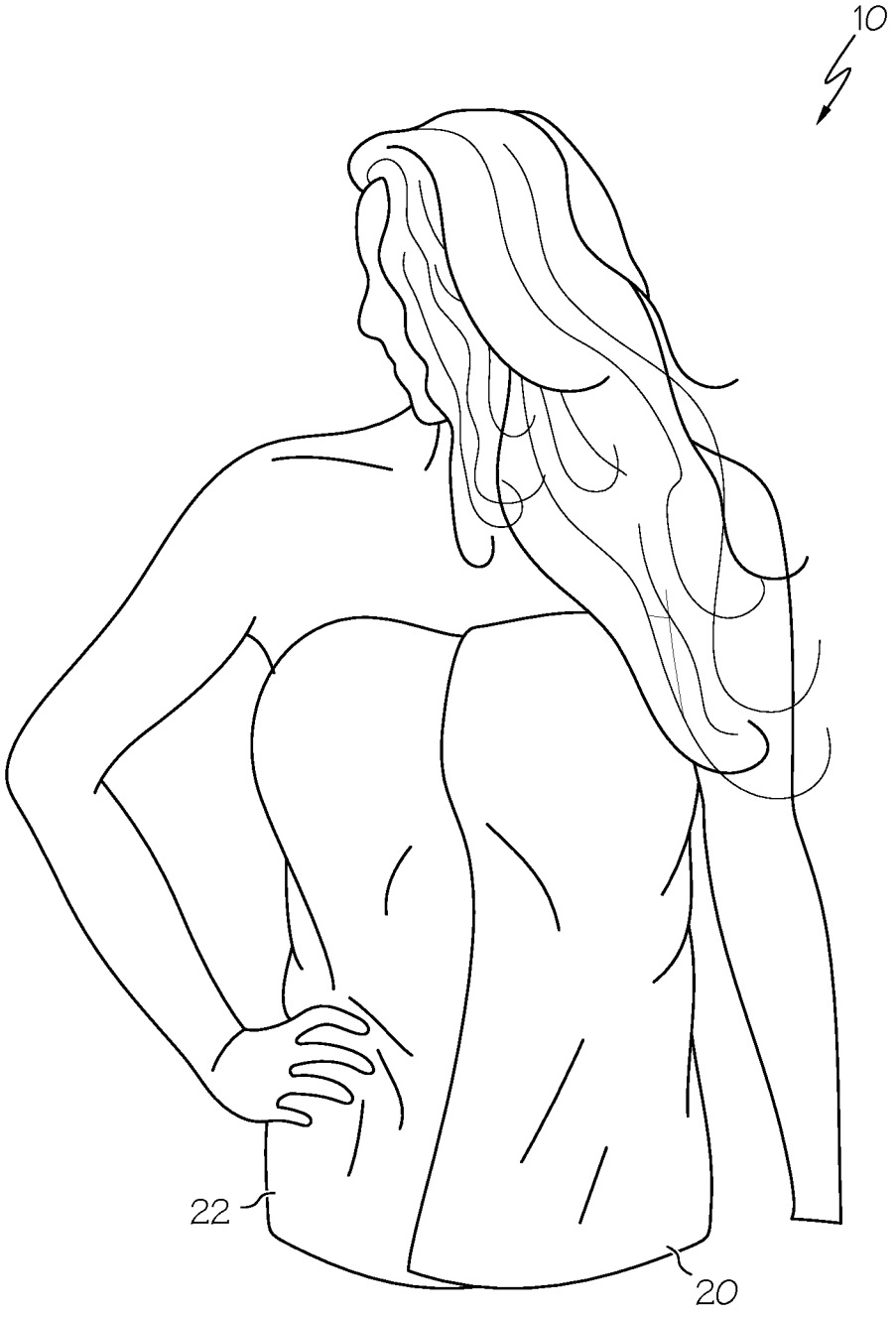

As illustrated in FIG. 9, the garment 10 may be used as a shirt. In this example, the connecting strings 40 located at the ends 24, 26 of the example may be tied together near the back of the wearer. The broad central bulk portion 22 of the bulk garment 10 may be used to cover at least part of the wearer's torso.

Figure 10:
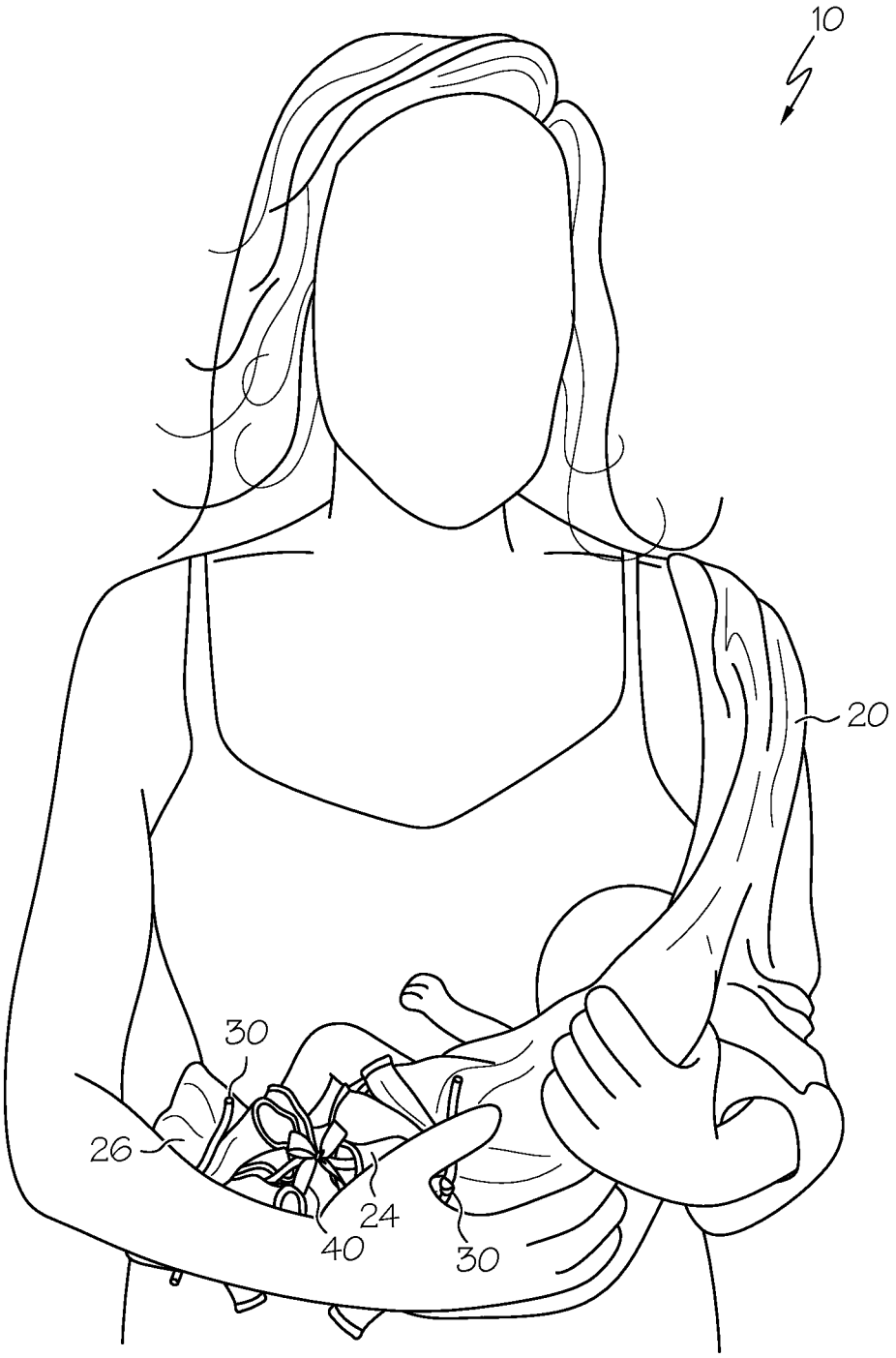

As illustrated in FIG. 10, the garment 10 may be used as a cover for a woman breastfeeding. In this example, the connecting strings 40 may be tied together to connect the ends 24, 26 of the garment 10. The garment 10 may then be draped over one shoulder, keeping the central bulk portion 22 of garment 10 over a baby and exposed breast.

Additional uses of the garment 10 will now be discussed that are not illustrated in the figures. The garment 10 may be used as a hood. In this example, the central bulk portion 22 of the material 20 may be wrapped over the wearer's head. The connecting strings 40 may be tied around the neck of the wearer to a desired tightness. Also, the garment 10 may be used as a bikini cover-up. In this example, the bundling strings 30 may be separated from the material 20, allowing the bundling strings 30 to optionally be removed. The garment 10 may be used as a bikini cover-up by tying the connecting strings 40 around the wearer's waist leaving the ends unbundled to drape over the legs of the wearer.

Furthermore, the garment 10 may be used as a belt. In this example, the connecting strings 40 may be tied together to connect the ends 24, 26 of the garment 10. The central bulk portion 22 of the material 20 may be twisted or held such that the material 20 may remain compact. The garment 10 may then be wrapped around the waist or pant line of the wearer. The garment 10 may be optionally passed through one or more belt loops included in another article of clothing, such as pants or a jacket. There may be multiple further uses not mentioned above.

Figure 11:
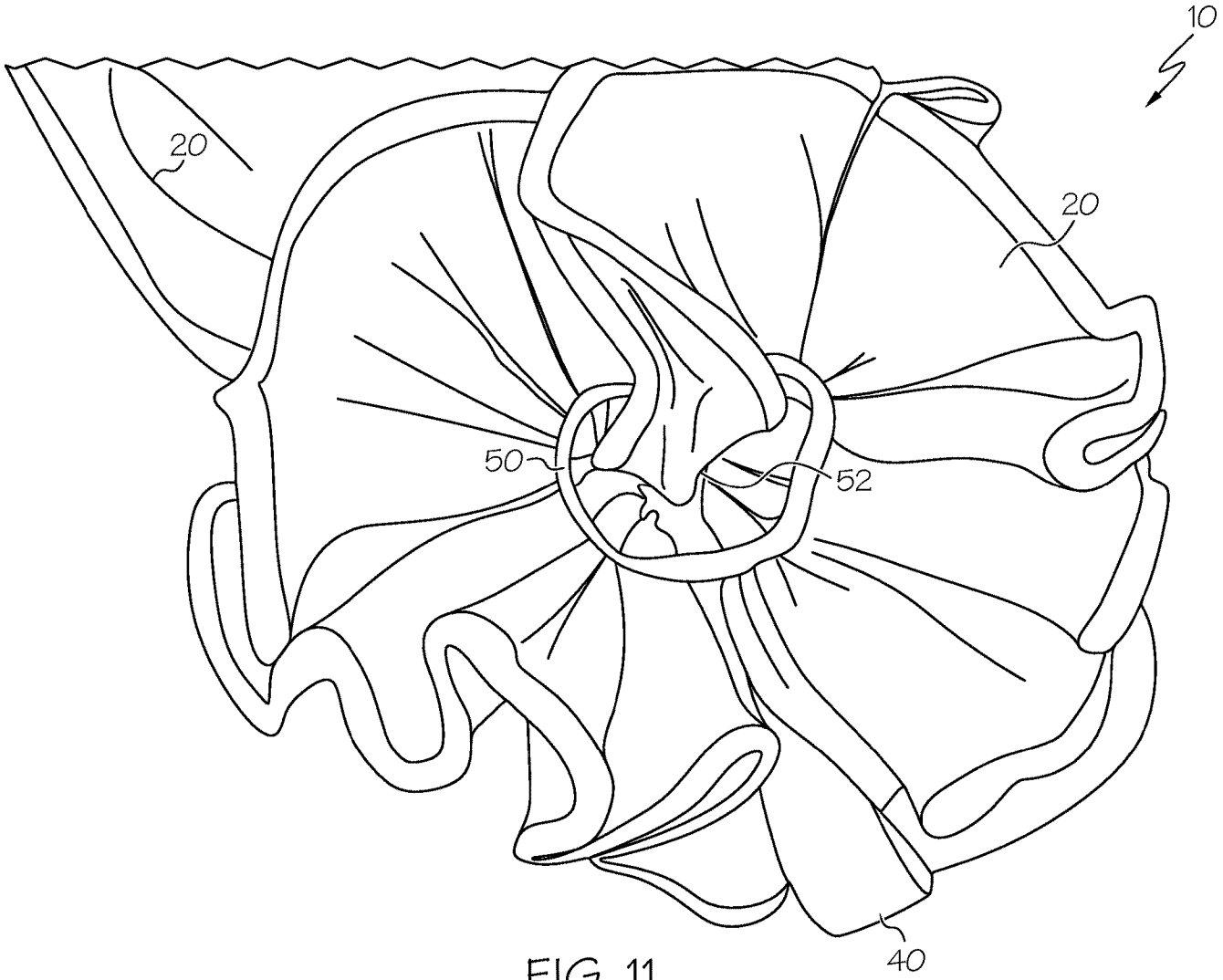
FIGS. 11-12 are perspective views of the garment including band, according to an embodiment of the present invention.
Figure 12:
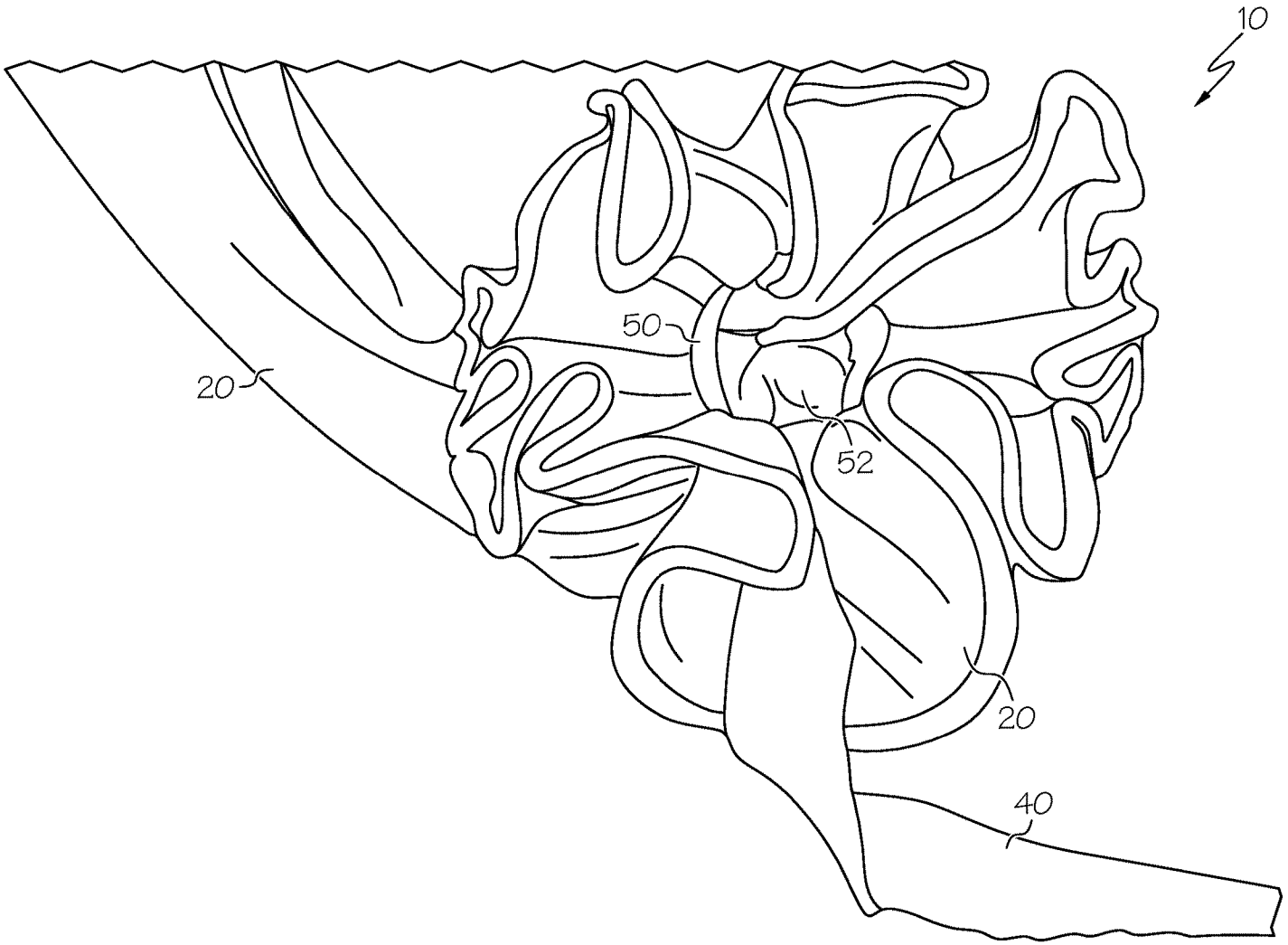

Referring now additionally to FIGS. 11 and 12, a configuration of the invention including bands will now be discussed. Bands 50 may be included near the ends 24, 26 of the garment 10 to compact a portion of rectangular material 20 located near each end. A band 50 may be a circular piece of material, which may include fabric, textile, and/or other materials. The band 50 may be constructed using a stretchable material, such as, for example, elastic materials. Skilled artisans will appreciate additional stretchable and non-stretchable materials that may be used to construct the band 50 that are consistent with the scope of this disclosure. The bands 50 may be used to compact each of a portion of the bulk section material 22 at the first end 24 and a portion of the bulk section material 22 at the second end 24 compacted into circular or annular configurations.

Before the band 50 is formed, the material used to construct the band 50 may be configured as an elongated length with opposing distal ends. To form the band 50, the length of band material may be bent such that the distal ends are near or adjacent to each other. The distal ends may be sown, adhered, welded, or otherwise attached to one another to form a looped configuration. Alternatively, the band material may be looped and sown, adhered, welded, or otherwise attached to a portion of the material 20 of the garment 10 to form the band 50. After being formed, the band 50 may include an opening 52 in the center of the material looped to form the band 50.

Material 20 of the garment 10 may be attached to the band 50, for example, near the first and second ends 24, 26 of the garment. As with forming the band 50, the material 20 may be sown, adhered, welded, or otherwise attached to the band 20. The material 20 may be attached to the band 50 such that a length of excess material 20 extends outward from the attachment point to the band 50 and toward an end of the garment 10.

The band 50 may be smaller than a width of the material 20 attached to the band 50. The material 20 may be at least partially compacted prior to being attached to the band 50, as can be seen in FIG. 11. However, those of skill in the art will appreciate additional ratios of band diameter to material diameter that are consistent with the disclosure, without limitation.

In an embodiment of the present invention, the band 50 may be attached to the material 20 at the inside of the garment 10. Internal attachment may advantageously conceal the band 50 while the garment 10 is being worn, increasing its aesthetic appeal. Alternatively, a band 50 may encircle the material 20 on its outer surface, which may provide an additional decorative appearance.

The band 50 may be included with the garment 10 along with the bundling strings 30 and/or the connecting strings 40. Alternatively, the garment 10 may be configured with the bands 50 and excluding the bundling strings 30 and connecting strings 40. Skilled artisan will appreciate that various configurations of the garment including bands 50, bundling strings 30, and/or connecting strings 40 are intended to be included within the scope of the present invention.

The first and second ends 24, 26 of the garment 10 may be connectable to each other using the bands 50. For example, the first end 24 of the garment 10 may be inserted into the opening 52 of a second band, which may be located near the second end 26 of the garment 10. Alternatively, the second end 26 of the garment 10 may be inserted into the opening 52 of a first band, which may be located near the first end 24 of the garment 10. The band 50 may have sufficient stretching and/or elastic properties to hold the opposing end within the opening 52 of the band 50, for example, via compressive force. The connecting strings 40 may additionally be tied to assist in securing the ends 24, 26 together.

In operation, a method may be provided for using a convertible garment having bands. First, the garment may be prepared to be positioned adjacent to at least part of a wearer. More specifically, the first and second ends of the garment may be positioned approximately adjacent to each other such to at least partially encircle the garment around at least part of the wearer. The garment may then be positioned to cover at least part of the wearer. The compactness of the bulk section of the garment may be manipulated relative to a length of the wearer to be covered. Additionally, the first and second ends may be positioned relative to one another to secure the garment to the wearer.

In an embodiment of the method, the bulk section of material may be wrapped around the body of the wearer. In embodiments wherein the garment includes bundling strings, the bundling strings may at least partially encircle the material near the first and/or second ends and be adjusted to bundle the material near the respective ends with a selectable level of compactness. The bundling strings are independently adjustable at each of the first and second ends. In embodiments wherein the garment includes connecting strings, the connecting strings may be positioned near each other when that the first and second ends of the garment are near each other. The connecting strings located at the first and second ends may then be connected to fasten the first end to the second end.

OTHER EMBODIMENTS

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A convertible garment for covering a body of a wearer consisting of:

a rectangular material consisting of a bulk section between opposing ends, wherein the bulk section consists of parallel horizontal sides and parallel vertical sides, wherein the opposing ends consists of a first end and a second end, wherein the first end consists of a portion of the bulk section at the first end compacted into a first circular configuration and the second end consists of a portion of the bulk section at the second end compacted into a second circular configuration, the rectangular material of the bulk section being manipulable to cover at least part of the body of the wearer; wherein the bulk section of the rectangular material consists of a first surface on a first side of the rectangular material and a second surface on an opposing second side of the rectangular material;

an elastic first circular band for holding the compacted material of the first end in the first circular configuration, wherein the rectangular material near the first end is attached to the first circular band to form a first opening at which the rectangular material is compacted near the first end;

an elastic second circular band for holding the compacted material of the second end in the second circular configuration, wherein the rectangular material near the second end is attached to the second circular band to form a second opening at which the rectangular material is compacted near the second end; and a first connecting string attached to the rectangular material at the first end and a second connecting string attached to the rectangular material at the second end, the first connecting string and the second connecting string being removably connectable to one another to position the first end of the rectangular material adjacent to the second end of the rectangular material;

wherein a majority of the rectangular material is included in the bulk section, wherein a compactness of the majority of the rectangular material is adjustable;

wherein the rectangular material is configurable to adjustably cover the at least part of the body of the wearer;

wherein the first end of the rectangular material is insertable into the second opening, or the second end of the rectangular material is insertable into the first opening; and wherein the first end can be held within the second opening by compressive force of the second circular band, and the second end can be held within the first opening by compressive force of the first circular band; and wherein the horizontal sides are longer than the vertical sides, the horizontal sides being free-floating relative to one another.

2. A garment for use by a wearer consisting of:

a single unitary piece of rectangular material consisting of a bulk section between opposing ends, wherein the bulk section consists of parallel horizontal sides and parallel vertical sides, wherein the opposing ends consist of a first end and a second end, the rectangular material being manipulable to cover at least part of a body of the wearer;

a first circular band, wherein the rectangular material near the first end is attached to the first circular band to form a first opening at which the rectangular material is compacted near the first end;

a second circular band, wherein the rectangular material near the second end is attached to the second circular band to form a second opening at which the rectangular material is compacted near the second end; and a first connecting string at the first end and a second connecting string at the second end, the first connecting string and the second connecting string being removably connectable to one another to position the first end of the rectangular material adjacent to the second end of the rectangular material;

wherein a majority of the rectangular material is included in the bulk section, wherein a compactness of the majority of the rectangular material is adjustable;

wherein the rectangular material is configurable to adjustably cover the at least part of the body of the wearer;

wherein the bulk section is adjustable to cover a length of the body of the wearer between up to shoulders and hips of the wearer; and wherein the horizontal sides are longer than the vertical sides, the horizontal sides being free-floating relative to one another.

* * * * *